United States Patent [19]

Arce

[11] 4,134,172

[45] Jan. 16, 1979

[54] DISPOSABLE TOOTHBRUSH

[76] Inventor: Oscar A. Arce, 15136 Swanee La., Baldwin Park, Calif. 91706

[21] Appl. No.: 791,415

[22] Filed: Apr. 27, 1977

[51] Int. Cl.[2] ..... A47K 7/02

[52] U.S. Cl. ..... 15/167 R; 15/227

[58] Field of Search ..... 15/167 R, 167 A, 165, 15/227; 132/84 R, 84 A, 84 D

[56] References Cited

U.S. PATENT DOCUMENTS

| | | | |
|---|---|---|---|
| 1,894,413 | 1/1933 | Nenning | 15/167 R |
| 2,167,129 | 7/1939 | Sleeper | 15/167 R |
| 2,396,548 | 3/1946 | Allen | 15/167 R |
| 3,018,498 | 1/1962 | Wasserman | 15/167 R |

*Primary Examiner*—Leonard D. Christian
*Attorney, Agent, or Firm*—Jay H. Quartz

[57] ABSTRACT

The described toothbrush comprises a bristle-incorporating brushing element which is attached to a flexible sheath into which a person's finger can be inserted to control the brushing action of the brushing element. A second embodiment includes, in addition, at least one pair of expansible ears protruding upwardly from the brushing element to at least partially encircle the sheath extending therebetween for providing additional clamping action of the brushing element against a user's finger to provide improved control of the brushing action.

3 Claims, 8 Drawing Figures

DISPOSABLE TOOTHBRUSH

BACKGROUND OF THE INVENTION

This invention relates to toothbrushes and, more specifically, to disposable toothbrushes.

On many occasions when a person is away from home, it may be desirable for that person to brush his teeth after ingesting food. For example, a traveller may wish to do so after a meal on an airplane to feel more at ease when talking to fellow travellers, etc., and to maintain good dental hygiene while travelling. A person may prefer to brush his teeth after dinner before continuing on a date or attending a meeting. Parents may desire that their children brush after every meal even when away from home in order for the children to acquire good dental hygiene habits.

In each of the foregoing examples, a person could carry his toothbrush with him. However, that is usually inconvenient for many reasons including the fact that a tube of toothpaste would also normally have to be transported with the toothbrush and because return of a wet toothbrush to pocket or purse after use is undesirable. To overcome the toothpaste problems, a toothbrush has been marketed in the form of a pen including a clip for attachment to a pocket and a cartridge containing toothpaste. Although such units constitute an improvement, they are bulky, they present a hygiene problem when returned to a pocket in a wet condition after use, they are inconvenient for children to carry, and if lost by children, they are relatively costly to replace.

Thus, there is a present and continuing need for a small, inexpensive portable toothbrush.

SUMMARY OF THE INVENTION

The herein-described invention is embodied in a disposable toothbrush which comprises a finger-encasing element attached to a brushing element so that the latter can be guided by a person's finger into brushing relation with that person's teeth. A second embodiment further incorporates at least one pair of expansible ears attached to the brushing element so that the finger-encasing element extends longitudinally therebetween to compress the latter against a person's finger inserted therein.

The described toothbrush provides several advantages not associated with presently-available toothbrushes. One advantage is that the herein-described toothbrush can be manufactured inexpensively. This means that lost and/or discarded toothbrushes can be replaced at small cost and that parents can carry enough spare toothbrushes for an entire family. A concomitant advantage is that the described toothbrush is disposable. Another advantage is that it can be folded to provide a relatively small package for easy carrying either singly or in multiple units. Additionally, toothpaste can be conveniently carried among the bristles of the brushing element or separately in its own appropriately small package.

All of the foregoing and other advantages are obtainable without significantly sacrificing brushing effectiveness.

DESCRIPTION OF THE PREFERRED EMBODIMENT

Broadly, the herein-described invention comprises tubular finger-receiving means operably attached to tooth brushing means so that a user's finger inserted into the finger-receiving means can guide the brushing means into brushing contact with that user's teeth. Another embodiment further includes expansible means attached to the brushing means for providing additional clamping of the brushing means to a user's finger.

This invention having been described broadly, it will now be described more specifically with reference to the Figures in which the numeral 10 designates a disposable toothbrush comprising (a) finger-receiving means in the form of a sheath or cot 12 and (b) brushing means exemplified by a brushing element 14, operably interconnected as described hereinafter.

Figure 1:
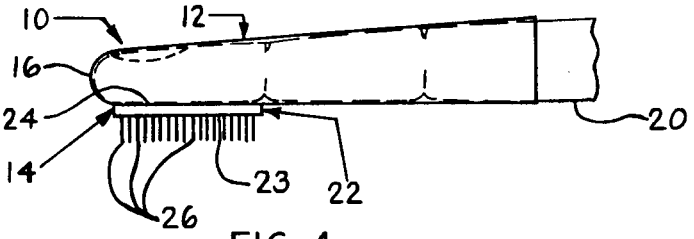
FIG. 1 is a side elevational view of the hereindescribed disposable toothbrush showing a person's finger in phantom line inserted therein.

The sheath 12 which has a closed or leading end 16 and an open or trailing end 18 is preferably sized to snugly receive a person's finger 20, usually an index finger, as shown in FIG. 1. To accomplish this, the sheath 12 is made from a radially expansible material, such as a natural or synthetic rubber, to permit radial expansion of the sheath from a non-expanded, but open (as opposed to collapsed) position (designated 12 in FIG. 2*a*) to an expanded position (shown in phantom line in FIG. 2*a* and designated 12') as shown by arrows 21, to thereby accommodate variously sized fingers. Because of the difference in finger size, the sheath 12 itself may be made in different sizes although each sheath size will preferably snugly fit a range of finger sizes.

Figure 3:
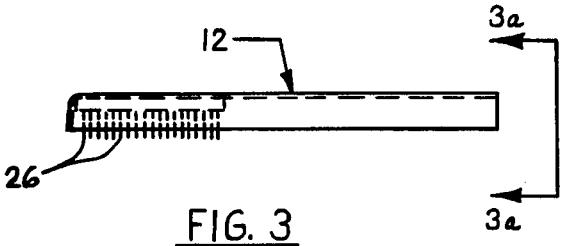
FIG. 3 is a side elevational view of the disposable toothbrush of FIG. 1 in its collapsed condition when a person's finger is removed therefrom.
Figure 3A:
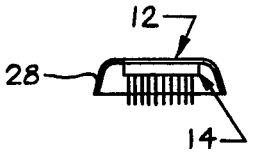
FIG. 3*a* is an end elevational view of the collapsed toothbrush of FIG. 3 taken along the line 3*a*–3*a*.
Figure 4:
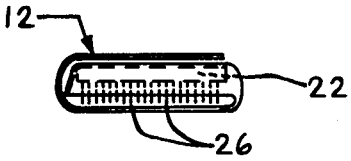
FIG. 4 is a side elevational view of the disposable toothbrush of FIG. 1 in its folded condition for packaging.

The material from which the sheath 12 is formed must be capable of being collapsed into an essentially flat or planar condition as shown in FIG. 3 and 3*a*. In the latter Figures, the forward and longitudinal peripheral areas of the sheath 12 are shown folded downward in flattened condition preparatory to packaging to form an overhanging or depending skirt 28 about the brushing element 14. To provide a compact package, the sheath 12 is typically folded back and under the brushing element 14 along the free ends of the bristles 26 and then returned over the upper side of the brushing element (see FIG. 4). Such folding is continued until the total length of the sheath 12 has been wound about the brushing element 14.

The sheath material in the thickness used must also be substantially impermeable to fluids found in a person's mouth and must have sufficient strength to resist tearing, etc., if it comes into contact with the teeth.

The brushing element 14 is preferably made as an integral unit, as by injection molding, and comprises a base 22 having oppositely-facing, preferably elongated surfaces 23,24 and a plurality of bristles 26 integrally depending from one such elongated surface 23 a distance sufficient to produce acceptable teeth cleaning. An integral brushing element 14 may advantageously be made from nylon. However, if a nonintegral element 14 is utilized, the bristles 26 may be made from the same or a different material as that used to form the base 22 as is well known.

The base 22 is made sufficiently thin to enable a person to adequately control the brushing action of the brushing element 14 (i.e., to prevent transverse (side-to-side) wobble of the brushing element). The idea is to place the bristles 26 as close to the person's finger as possible while maintaining the structural integrity of the base 22. This "working thickness" can be readily determined by trial and error for the particular material selected as the base material.

Preferably, the base 22 is made finger flexible, at least in a longitudinal direction (forward/rearward direction with respect to usage). That is, the base 22 is made so that it can be flexed by a person's operating finger so that the bristles 26 can more readily enter the interstices between that person's teeth and gums. The result is improved cleaning as compared to a brushing element having a stiff base. The base 22 is made finger flexible by judicious selection of the material forming the base and of the thickness for the base.

By way of example, with nylon as the base material, it has been determined that both a useful working thickness and finger flexibility were obtained with a base thickness of about 0.05 in. (1.27 mm.). It is to be understood, however, that base thicknesses both above and below the foregoing dimension may be useful.

The brushing element 14 is disposed along a longitudinal or side surface of the sheath 12 and is attached along its side 24 opposite the bristles 26 to the sheath adjacent the closed end 16 thereof to provide the requisite control (along with brushing element base thickness) over the brushing action of the brushing element. Attachment of the brushing element 14 to the sheath 12 may be made in a number of ways as is well known including bonding by the use of an adhesive e.g., an epoxy, and bonding by the use of heat to produce a heat seal. The brushing element 14, which is preferably rectangular in shape, is disposed along the side of the sheath 12, i.e., longitudinally thereof, so that they are longitudinally axially juxtaposed as shown particularly in FIG. 1.

Figure 2:
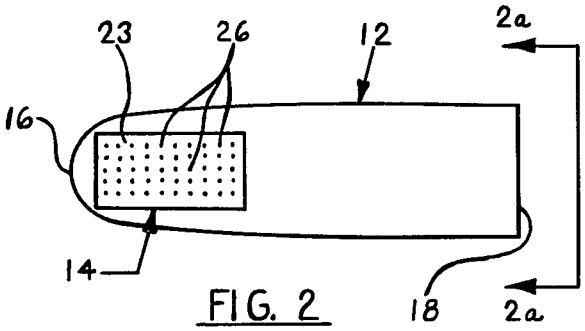
FIG. 2 is a bottom plan view of the disposable toothbrush of FIG. 1.
Figure 2A:
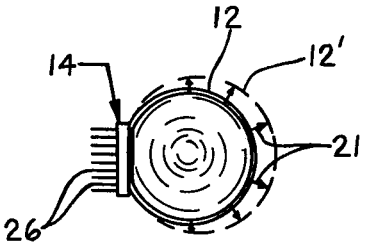
FIG. 2*a* is an end elevational view of the disposable toothbrush of FIG. 1 taken along the line 2*a*–2*a* of FIG. 2.
Figure 5:
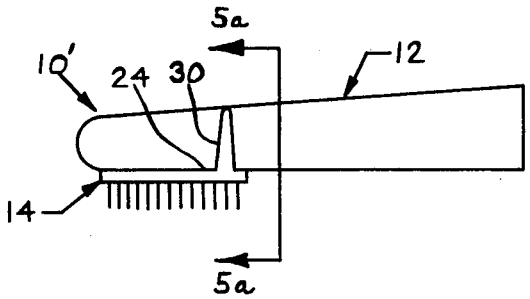
FIG. 5 is a side elevational view of an alternative embodiment of the disposable toothbrush of FIG. 1.
Figure 5A:
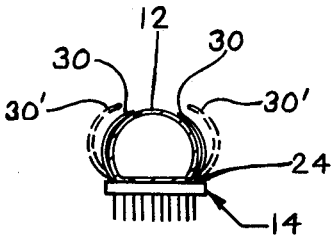
FIG. 5*a* is an end elevational view of the alternative embodiment shown in FIG. 5.

In FIGS. 5 and 5*a*, there is shown another embodiment 10' of the invention. The elements and numerals shown and used in FIG. 5 and 5*a* are the same as shown and used, respectively, in FIG. 1 except as follows. The disposable toothbrush 10' of FIG. 5 and 5*a* further includes at least one pair of opposing, radially expansible, preferably arcuate ears 30 projecting upwardly (as seen in FIG. 5 and 5*a*) from the upper surface 24 of the base 22 (or, alternatively, extending upwardly from a base side surface) to at least partially encircle the sheath 12 projecting therebetween. One pair of ears 30 is preferably disposed on the base distal from the closed end 16 of the sheath as shown in FIG. 5. The ears 30, which may also be formed from a plastic material such as nylon, are disposed with respect to the sheath 12 so that they will urge the sheath into contact with a person's finger through at least a radial size range having as its radially outer limit the non-expanded, open position or diameter of the sheath as shown in FIG. 2*a*. That is, the ears 30 must at least be functional (in terms of maintaining good contact between finger and brushing element 14) when the sheath 12 is not capable of fitting snugly over a finger (because the finger is too small in relation to the sheath). In this way, the gripping range of the sheath can be extended or supplemented by that of the ears. It is, of course, both permissible and desirable for the gripping ranges of the sheath and ears to overlap so that, in the region of overlap, both sheath and ears function to grip a person's finger. By way of example with reference to a particular disposable toothbrush, a too-thin finger (in relation to the sheath) would be gripped by the ears whereas a larger finger would be gripped by both the ears and sheath.

As illustrated in FIG. 5*a*, the ears 30 must be expansible from a position (solid line designated 30 in FIG. 5*a*) of smaller diameter than that of the non-expanded, open position of the sheath 12 to expanded positions (shown in phantom line and designated by the numeral 30' in FIG. 5*a*) having diameters at least as great as that of the sheath in its non-expanded open position. As noted, at each such position of the ears 30, they should be capable of urging the sheath into contact with a person's finger. As will be understood from the foregoing, use of the ears 30 overcomes the need to use a wide variety of sheath sizes.

To utilize the described embodiments of the disposable toothbrush, a person inserts his index finger into the sheath and, with or without toothpaste on the bristles, inserts the disposable toothbrush, forward or entering end first, in his mouth. Brushing is effected in the same manner as it would be when using a conventional toothbrush.

While the invention has been described in terms of a disposable toothbrush, it is to be understood that it could be reused after use and repacked in folded form as shown in FIG. 3 in a suitable small case for use at another time. Because of its small (folded) size, the described toothbrush can be carried in a very small container for reuse without thereby soiling a person's pocket or purse.

I claim:

1. A disposable toothbrush comprising:

radially-expansible, collapsible tubular finger-receiving means having a closed end and an open end and being radially expansible from a non-expanded, open position to an expanded position to snugly receive a plurality of finger sizes;

tooth brushing means comprising (a) a base having oppositely-facing first and second surfaces and (b) bristles depending from said second surface, said first surface being operably attached to said finger-receiving means longitudinally thereof adjacent said closed end; and at least one pair of opposing, radially-expansible ears extending upwardly from said base and adapted to at least partially encircle said finger-receiving means when a person's finger is inserted therein, said ears disposed on said base to urge said finger-receiving means into contact with said person's finger at least over a gripping range having as its radial outer limit the non-expanded, open diameter of said finger-receiving means, whereby said ears urge said finger-receiving means into contact with said person's finger at least when said person's finger is smaller than said finger-receiving means' non-expanded, open diameter.

2. A disposable toothbrush comprising:

a radially-expansible, collapsible sheath for receiving a user's finger, said sheath having a longitudinal axis, a closed end and an open end, said sheath being radially expansible from a non-expanded, open position to an expanded position to snugly receive a range of finger sizes;

a tooth brushing element comprising a base having oppositely-facing first and second surfaces and comprising bristles depending from said second surface of said base, said first surface of said base being attached to said sheath longitudinally thereof adjacent said closed end; and at least one pair of opposing, radially-expansible ears extending upwardly from said base and adapted to at least partially encircle said sheath when said user's finger is inserted therein, said ears disposed on said base to urge said sheath into contact with said person's finger at least over a gripping range having as its radial outer limit the diameter of said non-expanded, open position of said sheath, whereby said ears urge said sheath into contact with said user's finger at least when said user's finger is smaller in diameter than the diameter of said non-expanded, open position of said sheath.

3. The disposable toothbrush of claim 2 wherein said at least one pair of ears is disposed on said base distal from said closed end of said sheath.

* * * * *